US005404852A

United States Patent [19]

Fränkle

[11] Patent Number: 5,404,852

[45] Date of Patent: Apr. 11, 1995

[54] ARRANGEMENT FOR CONTROLLING AIR COMPRESSED IN A DIESEL ENGINE

[75] Inventor: Gerhard Fränkle, Remshalden, Germany

[73] Assignee: Mercedes-Benz AG, Stuttgart, Germany

[21] Appl. No.: 198,583

[22] Filed: Feb. 18, 1994

[30] Foreign Application Priority Data

Mar. 26, 1993 [DE] Germany ..... 43 09 860.6

[51] Int. Cl.[6] ..... F02D 13/04

[52] U.S. Cl. ..... 123/321

[58] Field of Search ..... 123/321, 322, 198 F, 123/320; 60/712; 417/237

[56] References Cited

U.S. PATENT DOCUMENTS

| | | | |
|---|---|---|---|
| 3,958,900 | 5/1976 | Ueno | 417/237 |
| 4,662,332 | 5/1987 | Bergmann et al. | 123/321 |
| 4,981,119 | 1/1991 | Neitz et al. | 123/321 |
| 5,150,678 | 9/1992 | Wittmann et al. | 123/321 |
| 5,315,974 | 5/1994 | Sabelstrom et al. | 123/321 |
| 5,357,926 | 10/1994 | Hu | 123/321 |

FOREIGN PATENT DOCUMENTS

| | | | |
|---|---|---|---|
| 4125831 | 10/1992 | Germany | 123/321 |
| 3117143 | 11/1992 | Germany | 123/321 |

*Primary Examiner*—Raymond A. Nelli
*Attorney, Agent, or Firm*—Klaus J. Bach

[57] ABSTRACT

In an arrangement for handling air compressed in a Diesel engine wherein a control valve is disposed in the cylinder head controlled by an electronic control unit so as to open during given periods in the compression strokes of the particular pistons and an air reservoir is in communication with the valve via a compressed air conduit, a two-way valve is arranged in the compressed air conduit and connected to the exhaust gas conduit of the engine and the two-way valve is switchable to open the compressed air conduit between the control valve and the air reservoir or to provide communication between the control valve and the exhaust gas conduit, the electronic control unit being capable of opening the control valve for charging the reservoir when the compression pressure in a cylinder reaches the operating pressure of the air in the reservoir.

6 Claims, 1 Drawing Sheet

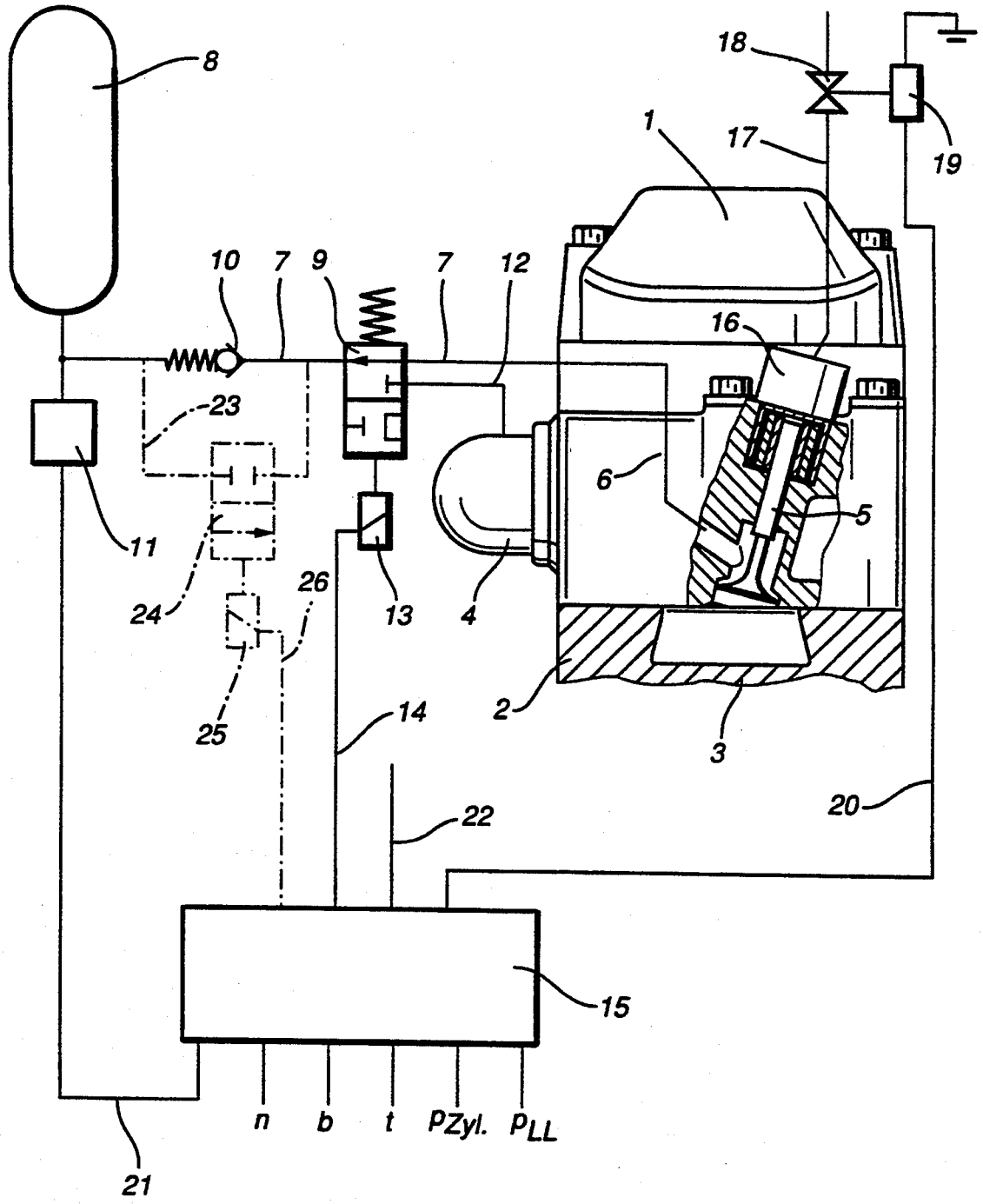
8
18
19
1
17
10
7
9
7
12
16
23
6
5
11
24
26
13
4
25
14
2
3
20
22
15
n
b
t
pZyl.
pLL
21

ARRANGEMENT FOR CONTROLLING AIR COMPRESSED IN A DIESEL ENGINE

BACKGROUND OF THE INVENTION

The invention relates to an arrangement for controlling the flow of air compressed in a Diesel engine or the supply of pressurized air or for engine braking.

Such an arrangement is known from an arrangement disclosed in the German Offenlegungsschrift 41 25 831 wherein a throttle valve is provided in the cylinder head of an internal combustion engine for each or various cylinders and this throttle valve controls air discharge into a discharge passage leading from the particular cylinder to the exhaust gas conduit. The throttle valve is actuated by an electromagnet as a function of control signals from an electronic control unit. A hydraulic or pneumatic actuation of the throttle valve is possible instead of an electromagnetic actuation. The object of this arrangement is to achieve optimum engine braking operation by releasing the air compressed in one or all the cylinders of the internal combustion engine shortly before the top dead center position of the particular piston by opening the corresponding throttle valve and throttling the compressed air into the exhaust gas conduit. The arrangement improves the braking performance as compared with conventional engine braking by means of an engine braking flap valve in the exhaust gas conduit. A disadvantage however is that the energy present in the compressed air is not utilized.

It is further known from German Offenlegungsschrift 31 17 143 to store the air compressed in the cylinders during braking operation in a compressed air reservoir and to teed it back into the cylinders during power operation in order to achieve a higher cylinder charge. In this case, the control of the compressed air takes place by means of the inlet and outlet valve structures which normally control the inlet and exhaust gas flow.

It is the principal object of the present invention to improve an arrangement of the generic type in such a way that utilization of the compressed air for engine operation and further application possibilities is achieved in a structurally simple manner.

SUMMARY OF THE INVENTION

In an arrangement for handling air compressed in a Diesel engine wherein a control valve disposed in the cylinder head is controlled by an electronic control unit so as to open during given periods in the compression strokes of the particular pistons and an air reservoir is in communication with the valve via a compressed air conduit, a switching valve is arranged in the compressed air conduit and connected to the exhaust gas conduit of the engine and the two-way valve is switchable to open the compressed air conduit between the control valve and the air reservoir or to provide communication between the control valve and the exhaust gas conduit, the electronic control unit being capable of opening the control valve for charging the reservoir when the compression pressure in a cylinder reaches the operating pressure of the air in the reservoir and, during braking, opening the control valves of only some of the cylinders and/or opening the control valves at a distance from the end of the compression stroke which depends on the desired braking force.

With the arrangement according to the invention, it is possible to collect the air compressed during engine braking operation in a compressed air reservoir and to utilize it for the vehicle operation, for example, as an auxiliary force for brake actuation or the control of other auxiliaries or even for engine operation. A further advantage of the arrangement according to the invention resides in the fact that compressed air can be supplied not only during engine braking operation, as is the case with prior art arrangements, but can be provided also during engine power operation. Accordingly, a special air compressor is no longer needed.

In a particular embodiment of the invention the cylinder charge can be increased during transient operation such as during acceleration when power requirements are increased for short periods of time and also to improve the smoke behavior of a Diesel engine by controlled air injection back in the cylinders of the engine.

BRIEF DESCRIPTION OF THE DRAWINGS

The sole FIGURE shows diagrammatically an embodiment of the invention.

DESCRIPTION OF THE PREFERRED EMBODIMENT

A cylinder head of a Diesel engine, which itself is not shown in detail and which is used for driving a vehicle, is indicated by numeral 1. The cylinder head covers one or more cylinders 2, in each of which a piston 3 is displaceably guided to compress inducted air. The gas exchange passages and gas inlet and outlet valves, which are arranged in the cylinder head 1 and by means of which the combustion air is introduced into the cylinders 2 and the exhaust gas resulting during the combustion is discharged from the cylinder 2 into an exhaust gas conduit 4, are not shown.

In addition to the gas inlet and outlet valves, control valves 5 are provided in the cylinder head 1 for all the cylinders 2 or combustion chambers or only for particular cylinders 2 by which discharge of compressed air from the cylinder 2 or the combustion chamber into a compressed air discharge passage 6 in the cylinder head 1 is controlled. A compressed air conduit 7 is connected to the discharge passage 6 outside the cylinder head 1 and this compressed air conduit 7 is connected to a compressed air reservoir 8. A two-way valve 9 is provided as a switching valve in the compressed air conduit 7 and also a non-return valve 10, to prevent discharge of pressurized air from the reservoir 8 back into the compressed air conduit 7. The non-return valve 10 only opens when the pressure in the compressed air conduit 7 is higher than that in the reservoir 8. A pressure sensor 11, which is connected in the compressed air conduit 7 so as to be in open communication with the reservoir 8, is used for monitoring the operating pressure in the pressure reservoir 8. A blow-down conduit 12 connected to the exhaust gas conduit 4 is also connected to the switching valve 9.

In a first switching position, the two-way valve 9 provides a through-flow connection for the compressed air conduit 7, with the blow-down conduit 12 shut off. In a second switching position, the through-flow connection in the compressed air conduit 7 is interrupted but a flow path from the discharge passage 6 via the compressed air conduit 7 to the blow-down conduit 12 is provided.

Operation of the switching valve 9 is by means of an electromagnet 13 which is connected to an electronic control unit 15 via a control line 14. This control unit 15 also controls the control valve 5, which is actuated by a control piston 16 operated by a hydraulic or pneumatic control medium supplied through a pressure conduit 17. A control valve 18 is arranged in the pressure conduit 17 and this control valve 18 is controlled by an electromagnet 19 which is connected to the control unit 15 via a control line 20. The input parameters for the control unit 15 are, for example, the parameters of operating pressure of the reservoir 8, which is transmitted from the pressure sensor 11 via a signal transmission line 21 and, in addition, the engine rotational speed n, the ambient temperature t, an acceleration signal b, possibly the compression pressure $p_{Zyl}$ and, in the case of a supercharged Diesel engine, the boost pressure $p_{LL}$. Control signals are formed by the control unit 15 from the input parameters in accordance with a predetermined program and these control signals are used to address the two electromagnets 13 and 19 via the control lines 14 and 20, and a fuel quantity control element (not shown) via the control line 22.

The arrangement described can be employed top engine braking operation or for compressed air generation.

Operation of the arrangement in the engine braking mode:

It a need for braking operation is recognized by the control unit 15 on the basis of input parameters or by manual actuation by the driver, the control unit 15 sets the two-way valve 9 to the second control position in which communication is established between the blowdown conduit 12 and the discharge passage 6. Simultaneously, the fuel supply is interrupted by means of the control line 22 and the valve 5 is opened in pulses whenever the piston 3 approaches the top dead center position during the compression stroke. The air compressed up to this point is then blown down through the control valve 5 into the exhaust gas conduit 4. Due to the opening of the control valve 5 near or at the top dead center position of the piston, the air is compressed to the highest possible final pressure before it is discharged resulting in maximum engine braking effect. The braking effect can be varied by selection of the number of cylinders utilized for engine braking operation.

Another possibility for altering the engine braking effect consists in advancing the opening time of the control valve 5 to a point ahead of top dead center where the compression pressure is at a lower than final pressure.

If a low limit pressure in the reservoir 8 is reported by the sensor 11, the compressed air is supplied via the compressed air conduit 7 to the reservoir 8 during engine braking operation until such time as the permissible upper limit pressure of the reservoir 8 is reached. Only then is the switching valve 9 switched over and the air is blown down into the exhaust gas manifold of the exhaust gas conduit 4.

Operation of the arrangement in a compressed air generation mode:

If a lack of compressed air in the compressed air reservoir 8 is sensed by the pressure sensor 11, the two-way valve is set by the control unit 15 to the first control position in which the compressed air conduit is connected to the reservoir 8. Simultaneously, via the control line 20, the electromagnet 19 is energized in such a way that the control valve 5 is opened during the compression stroke of the piston 3 when the pressure in the cylinder 2 reaches the operating pressure sensed in the compressed air reservoir 8, that is, before the piston reaches top dead center, for supplying compressed air to the reservoir 8. The non-return valve 10 prevents compressed air from flowing back into the cylinder from the reservoir. As soon as the pressure sensor 11 indicates that full operating pressure in the compressed air reservoir has been reached, the control unit is switched over to the "engine braking" type of operation and the control valve 5 is closed.

If the capacity of the reservoir for the stored compressed air is large enough, the possibility exists—in accordance with a further embodiment of the invention—of injecting stored compressed air as additional air into the cylinder 2 for improved combustion. This is particularly advantageous during acceleration of the vehicle. By means of the arrangement according to the invention, this is achieved by adding to the compressed air conduit 7—as is indicated by dash-dotted lines—a by-pass conduit 23, which bypasses the non-return valve 10 and includes a valve 24 and an electromagnet 25 for actuating the valve 24. It is also necessary to supplement the mode or operation or the control unit 15 in a corresponding manner.

If an acceleration condition is recognized by the control unit 15 from an acceleration signal supplied thereto, the switching valve 9 and—via the control line 26 and the electromagnet 25—the valve 24 are switched to their open positions. The control valve 5 is then opened on each compression stroke or the piston 3 so that the opening takes place—depending on the operating pressure in the reservoir 8—in the region between the bottom dead center position or the piston 3 and a compression stroke position in which the compression pressure in the cylinder 2 is still just below the operating pressure in the compressed air reservoir 8. In this mode or operation again all the control valves, or only some of the control valves, can be controlled for the additional air supply operation.

In order to avoid excessively high compressed air temperatures in the reservoir 8, the control valve 5 can be closed during the upward motion or the piston 3.

It is pointed out that, for charging the reservoir 8, compressed air can be extracted during the compression strokes or the piston while the engine is normally operating. The missing air quantity for the combustion process is taken into account in the metering or the fuel quantity (injection quantity) by means or corresponding control signals supplied to the injection system via the control line 22.

With the arrangement, it is also possible to start the engine with the aid or the compressed air from the reservoir 8 by suitable timing or air supply to the cylinders so that the arrangement according to the invention also has the capability of operating as a compressed air starter.

What is claimed is:

1. An arrangement for handling air compressed by a piston of a Diesel engine, comprising a control valve disposed in the cylinder head and being electronically controllable, an electronic control unit for controlling operation of said control valve such that it can be opened and closed at any point in the compression stroke of the piston, an air reservoir in communication with said valve via a compressed air conduit, a switching valve arranged in said compressed air conduit and being connected to an exhaust gas conduit of said engine, said switching valve being selectively switchable to open said compressed air conduit between said control valve and said air reservoir or to provide communication between said control valve and said exhaust gas conduit for discharging compressed air from said control valve into said exhaust gas conduit, said electronic control unit being capable of opening said control valve for charging said reservoir when the compression pressure of the air in said cylinder reaches the operating pressure of the air in said reservoir,

2. An arrangement according to claim 1, wherein said compressed air conduit includes a non-return valve arranged so as to prevent return gas flow from said reservoir.

3. An arrangement according to claim 1, wherein said two-way valve is operable by an electromagnet.

4. An arrangement according to claim 1, wherein a by-pass conduit is provided around said non-return valve and said by-pass conduit includes an electromagnetically operable by-pass valve controllable by said control unit upon receipt of an accelerate signal for opening said by-pass valve for supplying compressed air to said control valve, said control unit further being adapted to open at the same time said control valve at the beginning of the compression stroke and closing when the air pressure in said cylinder reaches the pressure value of the compressed air in said reservoir and also to increase fuel injection into said cylinder so as to increase power output from said engine for improved acceleration.

5. An arrangement according to claim 1, wherein said engine is a multi-cylinder engine and said electronic control unit adapted, during engine braking operation, to open the control valves of only selected ones of said cylinders depending on the desired engine braking force.

6. An arrangement according to claim 1, wherein said electronic control unit is adapted, during engine braking operation, to open said control valves at a point of the compression stroke depending on the desired engine braking force.

* * * * *